US008565043B2

(12) United States Patent
Hama

(10) Patent No.: US 8,565,043 B2
(45) Date of Patent: Oct. 22, 2013

(54) ACOUSTIC TRANSDUCER

(75) Inventor: Yoshinori Hama, Tokyo (JP)

(73) Assignee: NEC Corporation, Tokyo (JP)

( * ) Notice: Subject to any disclaimer, the term of this patent is extended or adjusted under 35 U.S.C. 154(b) by 592 days.

(21) Appl. No.: 12/891,922

(22) Filed: Sep. 28, 2010

(65) Prior Publication Data

US 2011/0075521 A1 Mar. 31, 2011

(30) Foreign Application Priority Data

Sep. 29, 2009 (JP) ..... 2009-224456

(51) Int. Cl.
*H04R 17/10* (2006.01)

(52) U.S. Cl.
USPC ..... 367/174

(58) Field of Classification Search
USPC ..... 367/160, 163, 174, 140
See application file for complete search history.

(56) References Cited

U.S. PATENT DOCUMENTS

| | | | | |
|---|---|---|---|---|
| 4,894,811 | A * | 1/1990 | Porzio | 367/174 |
| 4,922,470 | A | 5/1990 | McMahon et al. | |
| 5,805,529 | A * | 9/1998 | Purcell | 367/163 |
| 8,265,307 | B2 * | 9/2012 | Hama | 381/150 |
| 2011/0002484 | A1 * | 1/2011 | Hama | 381/152 |
| 2011/0075521 | A1 * | 3/2011 | Hama | 367/160 |
| 2011/0280420 | A1 * | 11/2011 | Hama | 381/186 |

FOREIGN PATENT DOCUMENTS

| | | | |
|---|---|---|---|
| JP | 59-139789 | A | 8/1984 |
| JP | 61-43898 | A | 3/1986 |
| JP | 62-176397 | A | 8/1987 |
| JP | 2-238799 | A | 9/1990 |
| JP | 2001334210 | A | 12/2001 |
| JP | 2008244895 | A | 10/2008 |

OTHER PUBLICATIONS

"The basis and application of marine acoustics [Kaiyo-onkyo-no-kiso-to-ouyou in Japanese]", Marine acoustics society of Japan, Seizando-syoten, 2004, pp. 59-60.
Japanese Office Action for JP2009-224456 mailed on May 14, 2013 with Partial English Translation.

* cited by examiner

*Primary Examiner* — Daniel Pihulic

(57) ABSTRACT

An acoustic transducer that enables acoustic radiation at a low frequency and that also improves efficiency of the acoustic radiation into liquid is provided. The acoustic transducer according to the present invention includes bending vibration module 7 that is formed by at least one bending oscillating body 1 that has at least one plate type piezoelectric resonator 2 and diaphragm 3, and supporting member 9 for supporting bending vibration module 7. A plurality of bending vibration modules 7 are cylindrically arranged, and supporting members 9 radially protrude from shaft 8 provided at the center of the cylindrically arranged bending vibration modules 7 and are joined with the ends of diaphragms 3 of adjoining bending vibration modules 7.

17 Claims, 18 Drawing Sheets

ACOUSTIC TRANSDUCER

This application is based upon and claims the benefit of priority from Japanese patent application No. 2009-224456, filed on Sep. 29, 2009, the disclosure of which is incorporated herein in its entirety by reference.

BACKGROUND OF THE INVENTION

1. Field of the Invention

The present invention relates to an acoustic transducer, and more specifically to an acoustic transducer that is capable of radiating a sound wave into water.

2. Description of the Related Art

In case of underwater observation such as an oceanographic survey for observing the ocean floor, a sound wave is used instead of a light wave or a radio wave. This is because a light wave and a radio wave tend to attenuate in water, whereas a sound wave is quite resistant to attenuation even in water. Therefore, acoustic transducers using an oscillator are used as an apparatus for generating sound waves in water.

There are several types of acoustic transducer. As an example of related art, an acoustic transducer that uses a hollow cylindrical piezoelectric resonator is known (for example, "The basis and application of marine acoustics [Kaiyo-onkyo-no-kiso-to-ouyou in Japanese]", Marine acoustics society of Japan, Seizando-syoten, 2004, pp. 59-60 in Japanese). Electrodes are provided for the inside and outside of the cylindrical piezoelectric resonator so that the resonator is polarized in the direction of thickness, i.e., between the inside electrode and the outside electrode. Application of a voltage between the inside electrode and the outside electrode generates a breathing vibration, which is made by the cylindrical piezoelectric resonator uniformly transforming inwardly and outwardly in the radial direction. By using the breathing vibration, the acoustic transducer radiates a sound wave from its sides into the liquid. A free-flooding type acoustic transducer not only radiates a sound wave from the sides of the cylindrical piezoelectric resonator but also radiates a sound wave from inside of the hollow cylinder into the liquid filled in the hollow cylinder so that the sound wave is radiated outside the acoustic transducer by using the resonance of the water column of the liquid.

Another example of related art will be described. FIG. 1A is a schematic diagram of the appearance of an acoustic transducer that is formed by cylindrically arranged bending vibration modules, and FIG. 1B is a schematic diagram of the cross section along line A-A' of FIG. 1A. Bending vibration module 101 is formed by electrodes 104 provided for the inner surface and the outer surface of plate type piezoelectric resonator 102 with one of electrodes 104 joined to diaphragm 103. The acoustic transducer of the related art has cylindrically arranged bending vibration modules 101 with adjoining bending vibration modules 101 joined with each other (for example, Japanese Patent Laid-Open No. 02-238799). Bending vibration module 101 is provided with waterproof structure 110. Each bending vibration module 101 repeatedly bends to and from in the direction of the thickness. Accordingly, the acoustic transducer radiates a sound wave into surrounding liquid or radiates a sound wave by using the resonance of the water column of the liquid inside the cylinder formed by bending vibration modules 101.

Yet another example of related art will be described. FIG. 2A is a schematic diagram of the appearance of a barrel stave type acoustic transducer, FIG. 2B is a schematic diagram of a cross section of bending vibration module 101 of the acoustic transducer of FIG. 2A, and FIG. 2C is a schematic diagram showing the inside of the acoustic transducer of FIG. 2A. Although not shown in the figures, all the surfaces are provided with waterproof structures.

As shown in FIG. 2A, the barrel stave type acoustic transducer is formed by a plurality of cylindrically arranged bending vibration modules 101. Adjoining bending vibration modules 101 are placed having gap 105 between them without being joined together. Both ends of bending vibration module 101 are fixed to end plates 106.

As shown in FIG. 2B, electrodes 104 are provided on both sides of plate type piezoelectric resonator 102 of bending vibration module 101 with one of electrodes 104 joined to diaphragm 103.

As shown in FIG. 2C, supporting column 107 supports end plates 106 so that the space between end plates 106 does not change.

As shown in FIG. 3, the acoustic transducer of this configuration has gaps 105 allowing for flexural vibration of diaphragms 103 of bending vibration modules 101 with the places where diaphragms 103 and end plates 106 are jointed acting as fulcrums.

Also, the acoustic transducer called Diabolo, a modification of the barrel stave type acoustic transducer, will be described (for example, U.S. Pat. No. 4,922,470). FIG. 4A is a schematic diagram of the appearance of a Diabolo type acoustic transducer, and FIG. 4B is a schematic diagram of the cross section along the line A-A' of FIG. 4A.

A plurality of diaphragms 103 are cylindrically arranged with the both ends of diaphragms 103 fixed to end plates 106. Between end plates 106, cylindrical piezoelectric resonators 109 are layered in the axial direction. Further, shaft 108 is provided between end plates 106 to hold the central axis in place. Adjoining diaphragms 103 have gaps 105 therebetween without being joined together. Diaphragms 103 curve toward the central axis.

Cylindrical piezoelectric resonators 109 provided between end plates 106 are elastic in the axial direction. FIG. 5A shows end plates 106 and diaphragms 103 when cylindrical piezoelectric resonators 109 shown in FIG. 4A contract in the axial direction. FIG. 5B shows end plates 106 and diaphragms 103 when cylindrical piezoelectric resonators 109 shown in FIG. 4A expand in the axial direction. The dashed lines show end plates 106 and diaphragms 103 when cylindrical piezoelectric resonators 109 neither expand nor contract.

As shown in FIG. 5A, when cylindrical piezoelectric resonators 109 contract in the axial direction, the space between end plates 106 becomes smaller. Correspondingly, diaphragms 103 that curve toward the central axis further curve inward.

As shown in FIG. 5B, when cylindrical piezoelectric resonators 109 expand in the axial direction, the space between end plates 106 becomes bigger. Correspondingly, diaphragms 103 that curve toward the central axis are stretched out in the axial direction to make the curve smaller.

As such, in the Diabolo type acoustic transducer, the bending movement of diaphragms 103 is made as they further curve toward the central axis and are stretched out in the axial direction to make the curve smaller in accordance with the contracting and expanding of cylindrical piezoelectric resonators 109, and the bending movement is repeated to make vibration. If adjoining diaphragms 103 are joined together, they cannot make the bending movement; therefore, diaphragms 103 preferably have gaps 105 therebetween.

Although not shown in the figures, both the barrel stave type acoustic transducer and the Diabolo type acoustic transducer are entirely provided with waterproof structures that are covered with a synthetic resin, rubber, or the like.

The sound wave is radiated most efficiently from the cylindrical piezoelectric resonator of the acoustic transducer that directly uses the vibration of the hollow cylindrical piezoelectric resonator at the time of the occurrence of resonant vibration, which occurs when a wavelength of vertical vibration in the circumferential direction of the cylindrical piezoelectric resonator corresponds to the circumference of the cylindrical piezoelectric resonator. Since sound generally travels fast through the materials of the piezoelectric resonator, the cylindrical piezoelectric resonator, the diameter being 10 cm, for example, has a resonance frequency around 10 kHz. If the frequency of the vibration is lowered in order to efficiently radiate a sound wave at a low frequency, the wavelength of the vibration will be longer. Therefore, a larger sized acoustic transducer is required to radiate a sound wave at a low frequency, because a cylindrical piezoelectric resonator larger in diameter is preferable for that purpose.

When the cylindrical piezoelectric resonator having a small diameter has to be used at a breathing vibration lower than the resonance frequency, the amplitude of the breathing vibration is uniquely determined by the thickness of the cylindrical piezoelectric resonator, the piezoelectric constants of the piezoelectric materials of the cylindrical piezoelectric resonator, and the supplied voltage. Generally, a larger amplitude is required to radiate a sound wave at a low frequency than at a high frequency. If the cylindrical piezoelectric resonator is used at a breathing vibration lower than the resonance frequency, however, the amplitude of the breathing vibration will be smaller, which prevents efficient radiation of a sound wave.

As such, for efficient acoustic radiation at a low frequency, it is preferable to have the cylindrical piezoelectric resonator larger in diameter to provide a lower resonance frequency. In some cases, however, the cylindrical piezoelectric resonator cannot be made larger in diameter due to limitations in size so that the resonance frequency cannot be sufficiently reduced.

The free flooding type acoustic transducer that radiates a sound wave by using the breathing vibration of the cylindrical piezoelectric resonators may generate the bending vibration in the axial direction of the cylindrical piezoelectric resonators such that the transducer has portions that alternatively expand outward and inward. This type of acoustic transducer may also generate the flexural vibration in the circumferential direction of the cylindrical piezoelectric resonators such that the transducer has portions that alternatively expand outward and inward. Since the bending movements make both of the sound waves radiated from the outside and inside of the cylindrical piezoelectric resonators smaller, they lower the efficiency of the acoustic radiation of the acoustic transducer.

An acoustic transducer that is formed by cylindrically arranged bending vibration modules 101, one of the above-mentioned examples of related art, has adjoining bending vibration modules 101 joined together. Here, deformation of bending vibration modules 101 in the acoustic transducer formed by eight bending vibration modules 101 will be described. FIG. 6A shows bending vibration modules 101 expanding inward, and FIG. 6B shows bending vibration modules 101 expanding outward. As shown in FIG. 6A, when bending vibration modules 101 expand inward, the joints between them protrude outward. On the other hand, as shown in FIG. 6B, when bending vibration modules 101 expand outward, the joints between them may collapse inward in some cases. In this case, since such a high degree bending movement of the bending vibration modules that alternatively expand outward and inward in the circumferential direction is excited, the acoustic transducer cannot efficiently radiate a sound wave outward.

In the barrel stave type acoustic transducer, diaphragms 103 of bending vibration modules 101 have maximum deformation in their central regions. However, since the acoustic transducer is entirely provided with a waterproof structure as mentioned above by being covered with rubber or the like, the waterproof structure may limit the amplitude of diaphragms 103. Moreover, under high water pressure, the liquid surrounding the acoustic transducer presses the waterproof structure, further limiting the amplitude of diaphragms 103. That prevents improvement of the efficiency of acoustic radiation.

As mentioned above, the Diabolo type acoustic transducer is adapted to have layered cylindrical piezoelectric resonators 109 deformed in the axial direction to deform end plates 106 to cause diaphragms 103, which have their both ends fixed to end plates 106, to vibrate. Since the deformation of cylindrical piezoelectric resonators 109 is not directly conveyed to diaphragms 103, however, efficiency of acoustic radiation with respect to the drive voltage is not so high.

SUMMARY OF THE INVENTION

An object of the present invention is to provide an acoustic transducer to solve the problems of difficulty in acoustic radiation at a low frequency and further to solve the problem in which it is difficult to improve the efficiency of the acoustic radiation into liquid.

The acoustic transducer according to the present invention includes a bending vibration module that is formed by at least a bending oscillating body that has at least a plate type piezoelectric resonator and a diaphragm, and a supporting member for supporting the bending vibration module. A plurality of the bending vibration modules are cylindrically arranged. The supporting members radially protrude from a shaft, which is provided at the center of the cylindrically arranged bending vibration modules, and are joined with the ends of the diaphragms of adjoining bending vibration modules.

The above and other objects, features and advantages of the present invention will become apparent from the following description with reference to the accompanying drawings which illustrate examples of the present invention.

DETAILED DESCRIPTION OF THE EXEMPLARY EMBODIMENTS

Exemplary embodiments will be described below with reference to the appended drawings. In the appended drawings, components having the same functions are denoted by the same numerals and description thereof may be omitted.

Figure 7A:
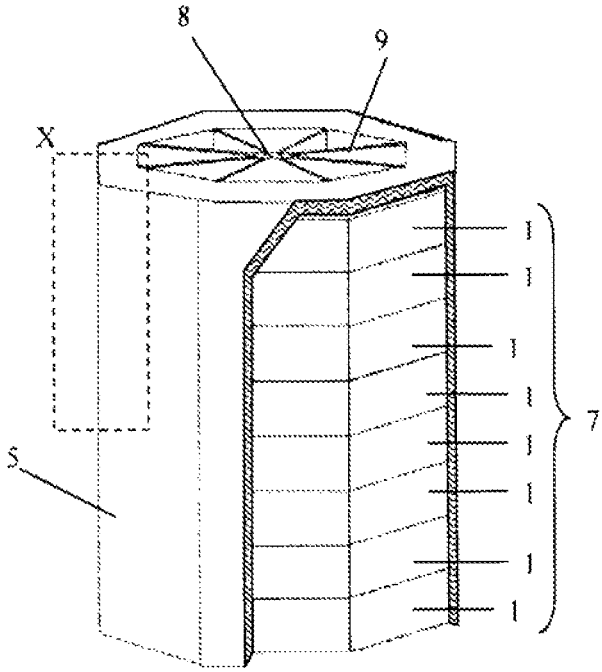
FIG. 7A is a schematic diagram of the appearance of an exemplary embodiment of a wheel type acoustic transducer according to the present invention.
Figure 7B:
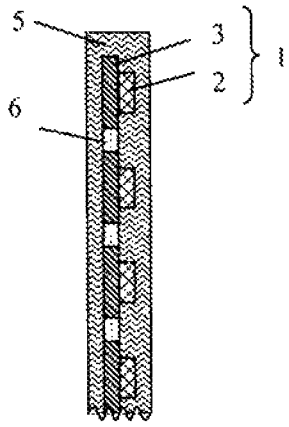
FIG. 7B is a schematic diagram of the cross section of the part denoted by X in FIG. 7A.

FIG. 7A is a schematic diagram of the appearance of a wheel type acoustic transducer according to the present invention. FIG. 7B is a schematic diagram of the cross section of the part denoted by X in FIG. 7A. Here, the acoustic transducer of the present invention has bending vibration modules 7 entirely provided with waterproof structure 5. For easier understanding of the configuration of the acoustic transducer, waterproof structure 5 is partly omitted in FIG. 7A.

As shown in FIG. 7A, the acoustic transducer of the exemplary embodiment has one bending vibration module 7 that is formed by a plurality of bending oscillating bodies 1 layered in the axial direction. A plurality of bending vibration modules 7 are cylindrically arranged. Bending vibration module 7 may be formed by only one bending oscillating body 1. Although not shown in FIG. 7A, shock-absorbing material 6 is provided between layered bending oscillating bodies 1 (see FIG. 7B). Bending vibration modules 7 are entirely provided with waterproof structure 5 covered with rubber, a synthetic resin, or the like. Shaft 8 is provided at the center of cylindrically arranged bending vibration modules 7. Supporting members 9 are provided from shaft 8 to the parts where bending vibration modules 7 adjoin. Supporting members 9 need not to be provided as one body for the entire part of bending vibration module 7 in the axial direction, i.e., from the top to the bottom of the adjoining part of bending vibration modules 7, and may be divided into a plurality of parts to be provided for the top region and the bottom region.

Figure 9:
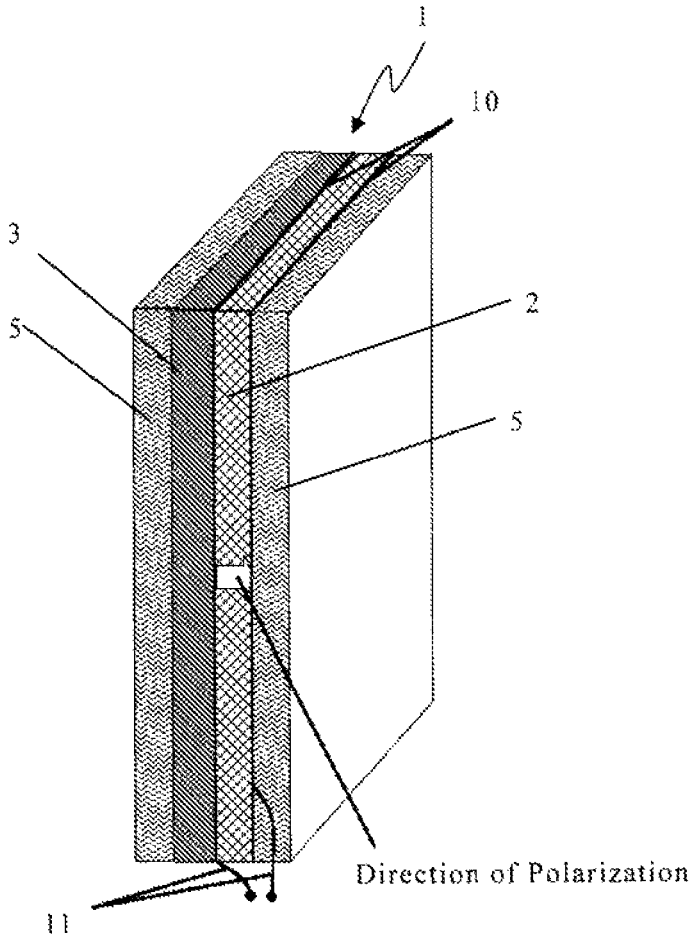
FIG. 9 is a schematic diagram of a bending oscillating body in unimorph structure.

As shown in FIG. 7B, bending oscillating body 1 is formed by diaphragm 3 made of metal, resin, or the like with plate type piezoelectric resonator 2 attached on one side (unimorph structure, see FIG. 9). Although not shown in FIGS. 7A and 7B, it may be formed by diaphragm 3 with plate type piezoelectric resonators 2 attached on both sides (bimorph structure, see FIG. 10). Bending vibration module 7 is formed by arranging two or more bending oscillating bodies 1 that are joined together via shock-absorbing material 6 or directly. As mentioned above, when bending vibration module 7 is formed by one bending oscillating body 1, shock-absorbing material 6 is not needed. With a rib in the axial direction, bending vibration in the axial direction of bending oscillating body 1 may be limited.

Figure 8A:
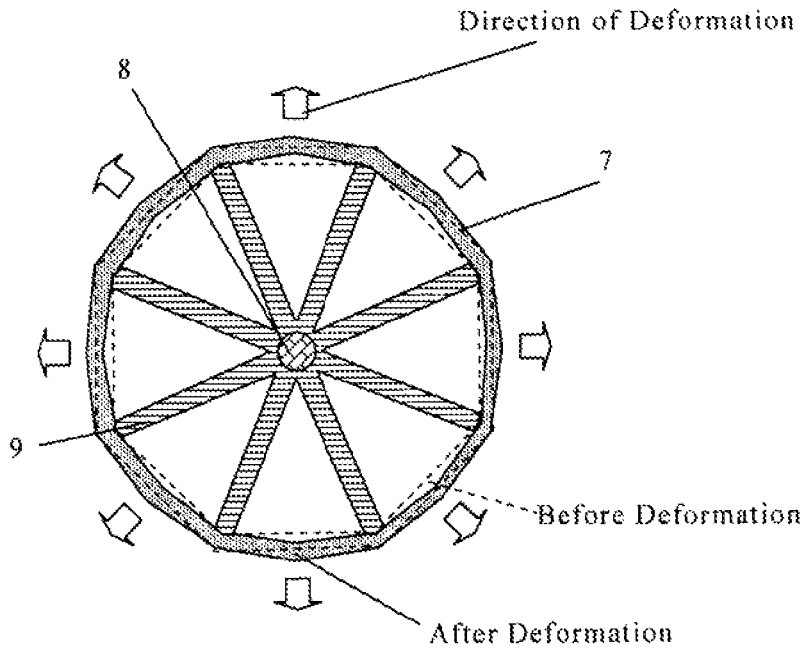
FIG. 8A is a diagram showing the bending vibration modules of the acoustic transducer of FIG. 7A when voltage is applied to deform the bending vibration modules outward.
Figure 8B:
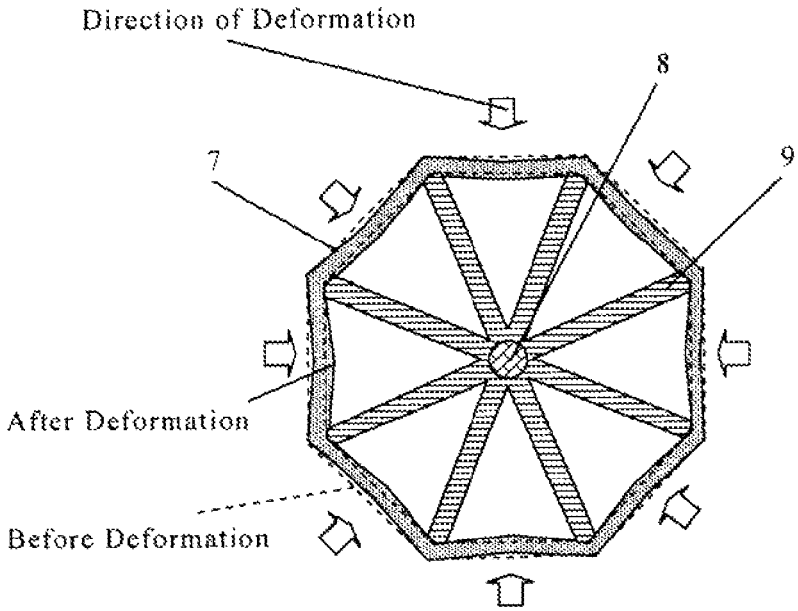
FIG. 8B is a diagram showing the bending vibration modules of the acoustic transducer of FIG. 7A when voltage is applied to deform the bending vibration modules inward.

When a voltage is applied to plate type piezoelectric resonators 2, bending vibration module 7 bends with supporting members 9 as fulcrums, i.e., nodes. As shown in FIG. 8A, when a voltage is applied to make bending vibration modules 7 deform outward, bending vibration modules 7 expand outward since supporting members 9 do not deform. As shown in FIG. 8B, when a voltage is applied to make bending vibration modules 7 deform inward, bending vibration modules 7 expand inward since supporting members 9 do not deform. Therefore, by applying an alternating voltage to plate type piezoelectric resonators 2, bending vibration module 7 is made to bend inward and outward alternately. Accordingly, both outward acoustic radiation from the outside surface of the acoustic transducer and acoustic radiation that uses the resonance of the water column occurring in the liquid in the hollow cylinder can be used.

Here, an operation of the acoustic transducer of the exemplary embodiment will be described in detail. Supporting members 9 provided from shaft 8 to the joints between bending vibration modules 7 have a function of making the joints between bending vibration modules 7 the fulcrums of vibration. Bending vibration modules 7 bend in response to the voltage applied. Electrodes 10 to be described later are connected so that all bending vibration modules 7 have the same direction of voltage and the same bending direction. This makes cylindrically arranged bending vibration modules 7 uniformly deform outward to push liquid outside from the surface of bending vibration modules 7. On the other hand, when the voltage is applied in the reverse direction, bending vibration modules 7 uniformly deform inward to receive liquid flowing to bending vibration modules 7 from outside. By the series of deformations, i.e., vibration, of bending vibration modules 7, a sound wave is radiated from the outside surface of bending vibration modules 7.

Liquid have been flown in the hollow of the cylindrical shaped acoustic transducer. By the vibration of bending vibration modules 7, the resonance of the water column of the liquid itself in the hollow is generated. In the case of the free flooding type acoustic transducer which is used by being submerged in liquid, efficient outwardly acoustic radiation can be realized when the resonance frequency of bending vibration modules 7 is made to correspond with the resonance frequency of the resonance of the water column. The acoustic radiation can be featured to cover a wide frequency range when the resonance frequencies are set to differ from each other a little.

Figure 1A:
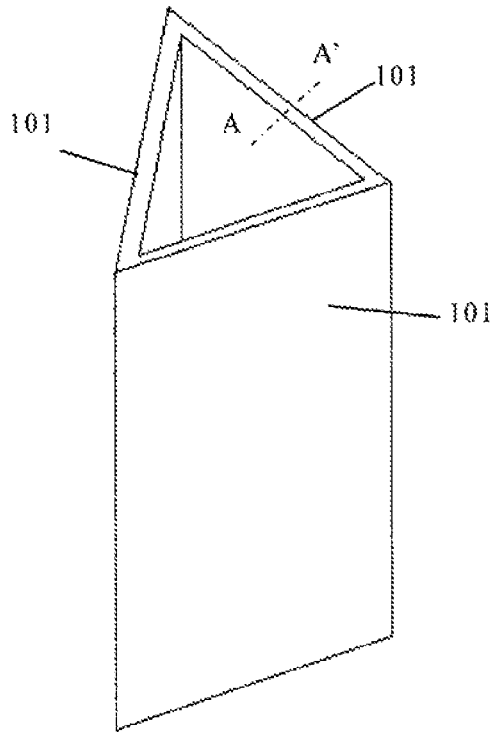
FIG. 1A is a schematic diagram of the appearance of an acoustic transducer that is formed by cylindrically arranged bending vibration modules of a related art.
Figure 1B:
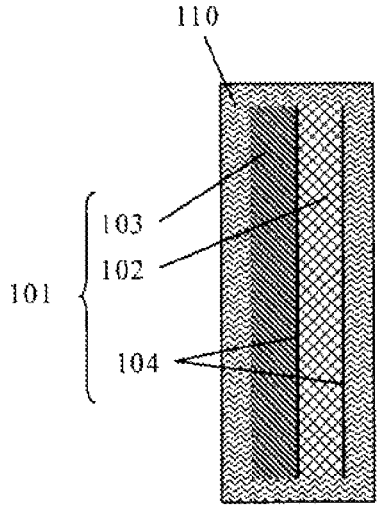
FIG. 1B is a schematic diagram of the cross section along line A-A' of FIG. 1A.
Figure 2A:
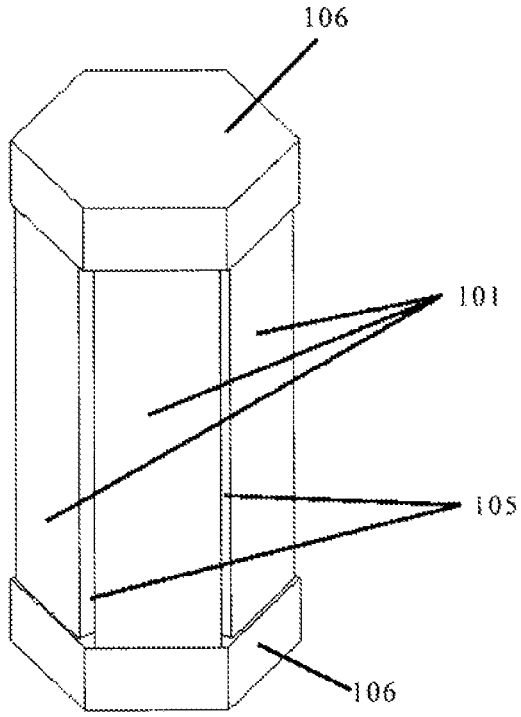
FIG. 2A is a schematic diagram of the appearance of a barrel stave type acoustic transducer of a related art.
Figure 2B:
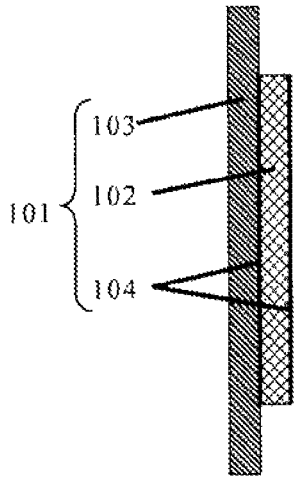
FIG. 2B is a schematic diagram of a cross section of the bending vibration module of the acoustic transducer of FIG. 2A.
Figure 2C:
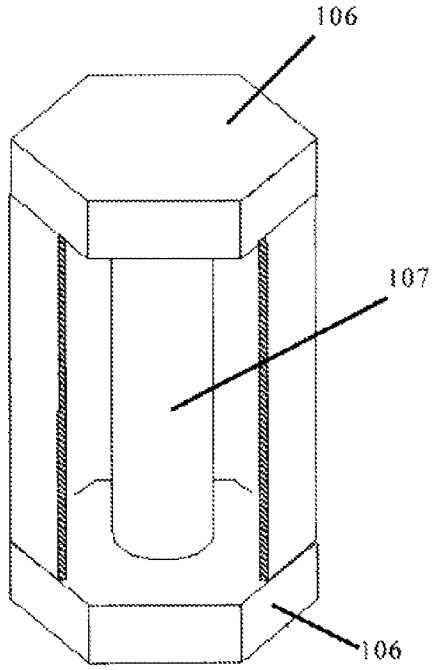
FIG. 2C is a schematic diagram showing the inside of the acoustic transducer of FIG. 2A.
Figure 3:
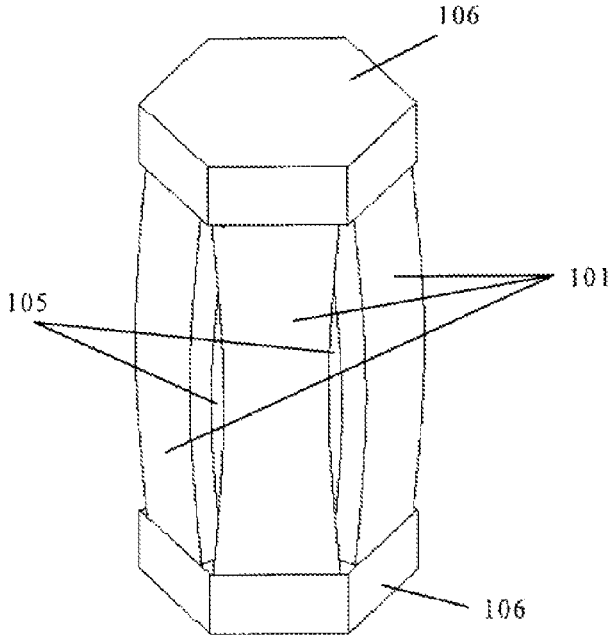
FIG. 3 is a schematic diagram showing flexural vibration of the acoustic transducer of FIG. 2A.
Figure 4A:
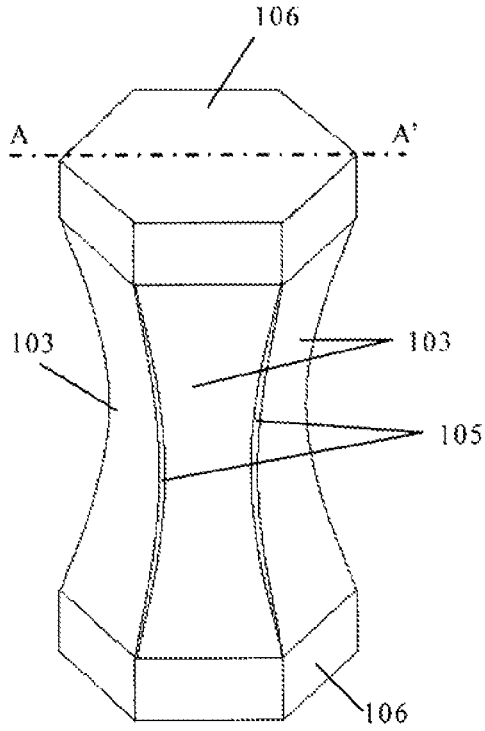
FIG. 4A is a schematic diagram of the appearance of a Diabolo type acoustic transducer of a related art.
Figure 4B:
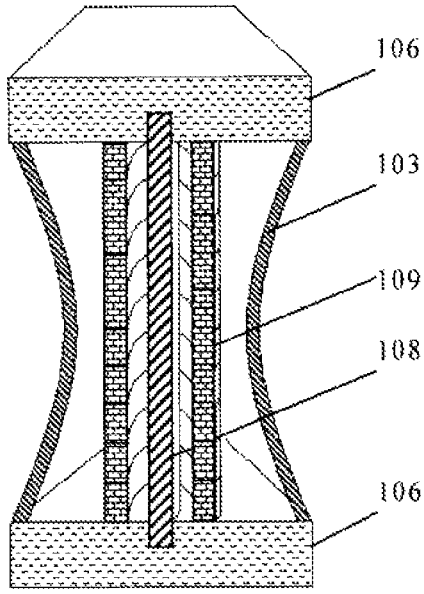
FIG. 4B is a schematic diagram of the cross section along line A-A' of FIG. 4A.
Figure 5A:
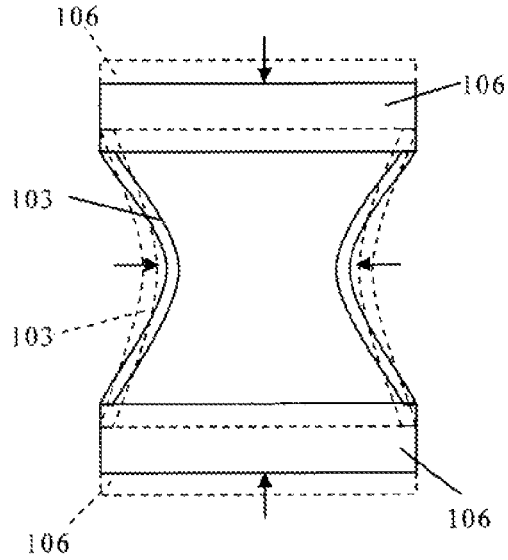
FIG. 5A is a diagram showing end plates and diaphragms when cylindrical piezoelectric resonators of FIG. 4A contract in the axial direction.
Figure 5B:
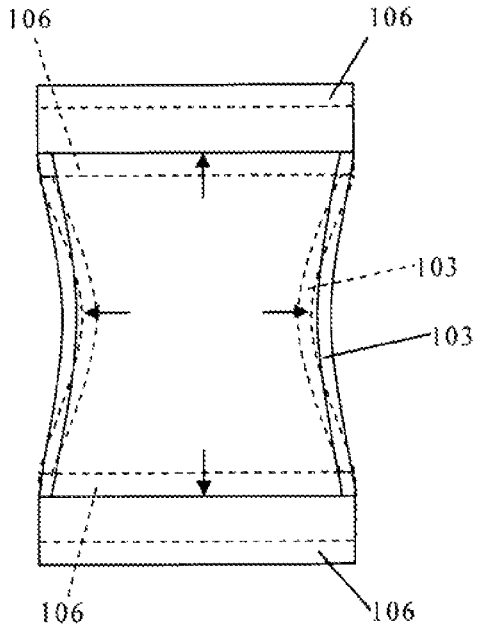
FIG. 5B is a diagram showing end plates and diaphragms when cylindrical piezoelectric resonators of FIG. 4A expand in the axial direction.
Figure 6A:
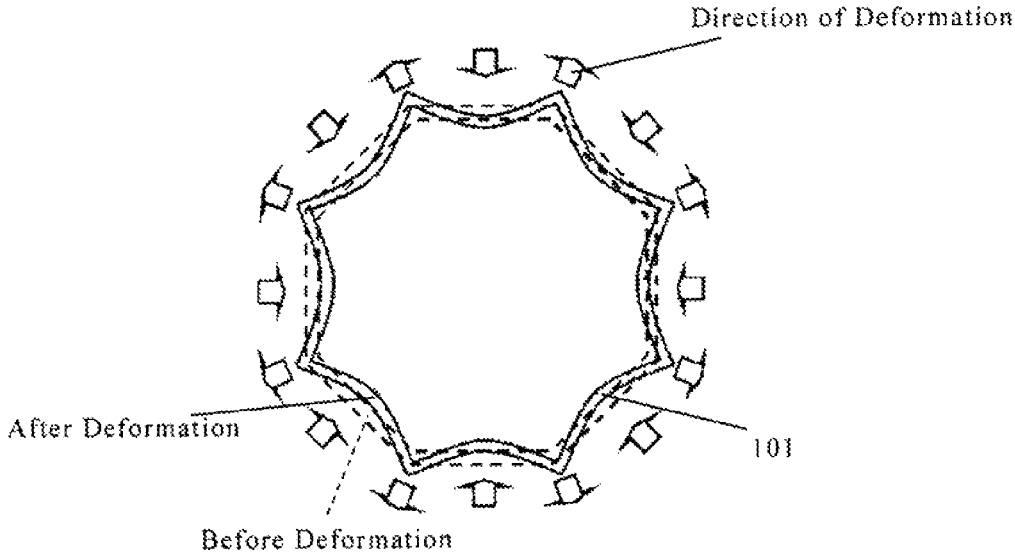
FIG. 6A is a diagram showing the bending vibration modules expanding inward.
Figure 6B:
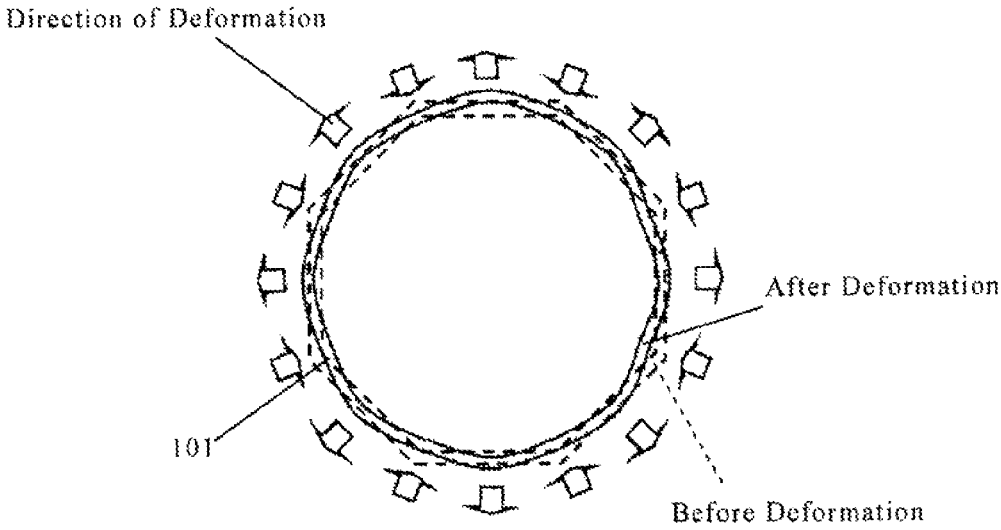
FIG. 6B is a diagram showing the bending vibration modules expanding outward.

The biggest feature of the acoustic transducer according to the present invention is that it is provided with supporting members 9. As mentioned above, without supporting members 9, supporting points of both ends of each bending vibration module 7 (both ends of adjoining bending vibration modules 7) move so that a high degree bending movement is excited in the acoustic transducer (see FIGS. 6A and 6B). Due to that movement, the part that pushes liquid outside and the part that receives liquid flowing toward it occur alternately in the circumferential direction so that the acoustic transducer cannot efficiently radiate a sound wave.

In the present invention, supporting members 9 are joined at the place where bending vibration modules 7 adjoin. Accordingly, the joint between bending vibration modules 7 and supporting members 9 is fixed even during the vibration of bending vibration modules 7 and is to be nodes during the vibration of bending vibration modules 7. During the vibration of bending vibration modules 7, pushing liquid outward from bending vibration modules 7 and receiving liquid flowing into the surface of bending vibration modules 7 are regularly performed one after the other so that the acoustic transducer can efficiently radiate a sound wave.

Bending oscillating body 1 can be configured variously. The configuration of bending oscillating body 1 will be described below in detail.

As a first exemplary embodiment of bending oscillating body 1, FIG. 9 shows a unimorph structure, in which plate type piezoelectric resonator 2 with electrodes 10 provided on both sides is attached to one side of diaphragm 3. From FIG. 9 through FIG. 13 (to be described later), the upper side of the acoustic transducer in the axial direction is at the front and the lower side of the acoustic transducer in the axial direction is at the back.

Plate type piezoelectric resonator 2 is polarized vertically to electrodes 10, i.e., in the thickness direction. When a voltage is applied between electrodes 10 via connecting cable 11, plate type piezoelectric resonator 2 vibrates in horizontal vibration mode (31 mode) for expanding and contracting in the cross direction.

Figure 10:
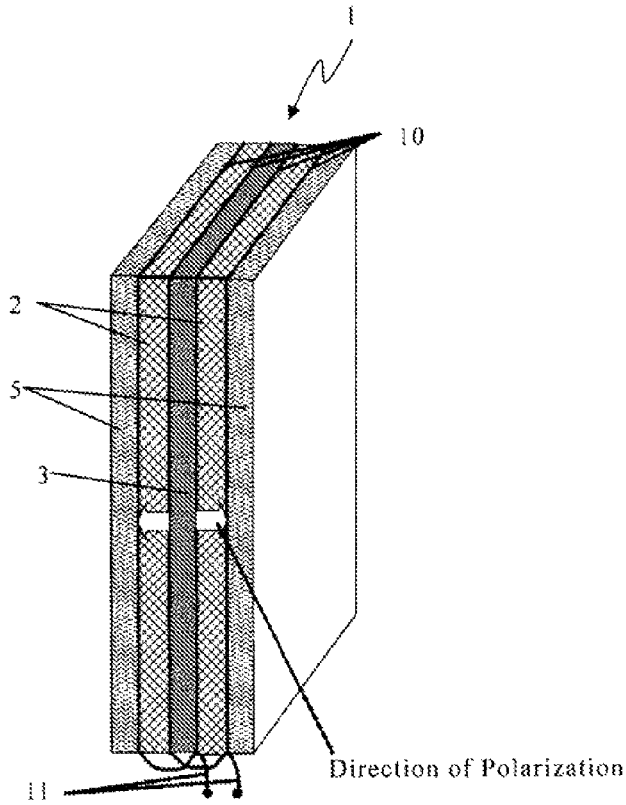
FIG. 10 is a schematic diagram of bending oscillating body in bimorph structure.

As a second exemplary embodiment of bending oscillating body 1, FIG. 10 shows a bimorph structure, in which plate type piezoelectric resonators 2 each with electrodes 10 provided on both sides are attached to both sides of diaphragm 3.

Plate type piezoelectric resonators 2 are polarized vertically to electrodes 10, i.e., in the thickness direction and symmetrically with respect to diaphragm 3. In this case, the electrode on the outside of one of plate type piezoelectric resonators 2 is connected with the electrode on the inside of the other plate type piezoelectric resonator 2, and the electrode on the inside of one of plate type piezoelectric resonators 2 is connected with the electrode on the outside of the other plate type piezoelectric resonator 2, and a voltage is applied between respective connecting cables 11. Although not shown here, in order to polarize plate type piezoelectric resonators 2 asymmetrically with respect to diaphragm 3, the electrodes on the outside of both of plate type piezoelectric resonators 2 are connected together and the electrodes on the inside of both of plate type piezoelectric resonators 2 are connected together, and a voltage is applied between two connecting cables 11 to have the effect.

Figure 11:
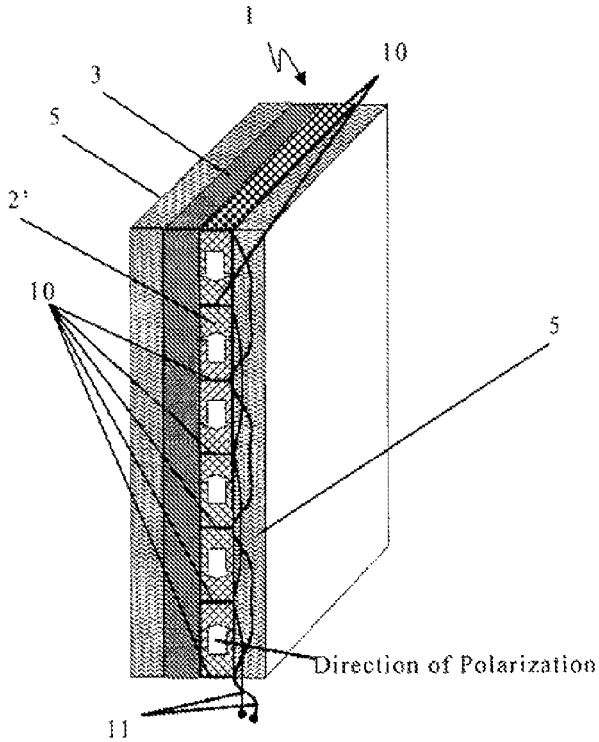
FIG. 11 is a schematic diagram of a bending oscillating body in unimorph structure with layered plate type piezoelectric resonators.

As a third exemplary embodiment of bending oscillating body 1, FIG. 11 shows a unimorph structure, in which layered plate type piezoelectric resonators 2' that are formed by layering small plate type piezoelectric resonators are used as plate type piezoelectric resonator 2.

Layered plate type piezoelectric resonators 2' are formed by small plate type piezoelectric resonators arranged in a row with electrodes 10 on joints thereof. Diaphragm 3 needs not to be an insulator, but if it is conductor, an insulating layer (now shown) needs to be provided. Here, each small plate type piezoelectric resonators is polarized in the direction of electrode 10, and opposite to that of the adjoining small plate type piezoelectric resonator. Electrodes 10 are alternately connected together via connecting cables 11 correspondingly to the polarization directions, and a voltage is applied to electrodes 10 via two connecting cables 11. Plate type piezoelectric resonators of the exemplary embodiment vibrate in vertical vibration mode (33 mode), in which the directions of polarization and the directions of the electric field generated between electrodes 10 are the same and the directions of expansion and contraction are also the same.

Figure 12:
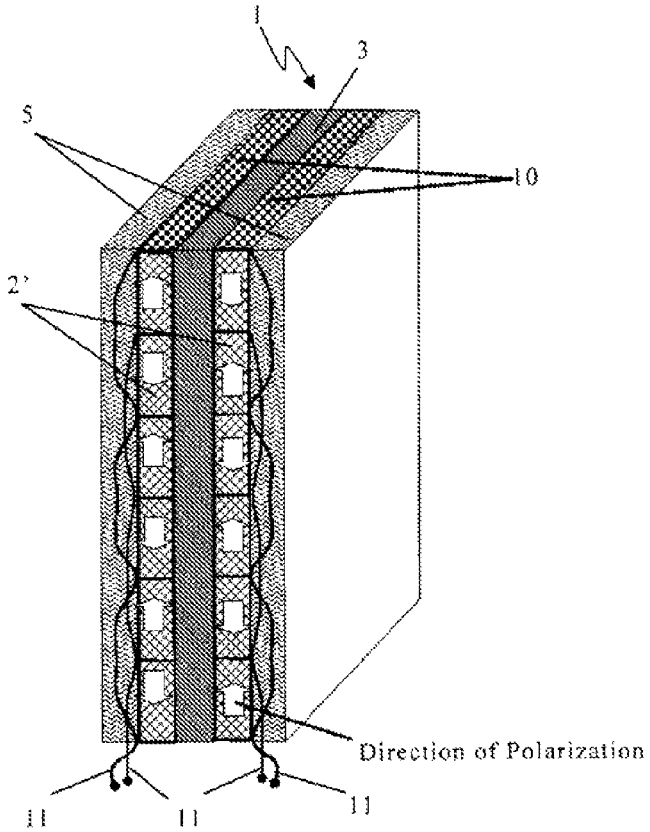
FIG. 12 is a schematic diagram of a bending oscillating body in bimorph structure with layered plate type piezoelectric resonators.

The structure described here is the unimorph structure that uses layered plate type piezoelectric resonators 2' on one side of diaphragm 3 as plate type piezoelectric resonator 2. As shown in FIG. 12, however, even when the 33 mode is used, the bimorph structure can be adopted as when the 31 mode is used. In this case, adjoining small plate type piezoelectric resonators are polarized in the direction of electrode 10, and alternately opposite to each other. Further, the small plate type piezoelectric resonators are polarized opposite to the polarization directions of the small plate type piezoelectric resonators across diaphragm 3. Electrodes 10 are alternately connected together via connecting cables 11 correspondingly to the polarization directions, and a voltage is applied to electrodes 10 via two connecting cables 11. Accordingly, layered plate type piezoelectric resonators 2' on one side contract, and layered plate type piezoelectric resonators 2' on the other side expand. As a result, bending oscillating body 1 generates in itself flexural deformation. Although not shown, the same effect can be obtained by making the polarization directions the same and the directions of connecting electrodes 10 in reverse.

Figure 13:
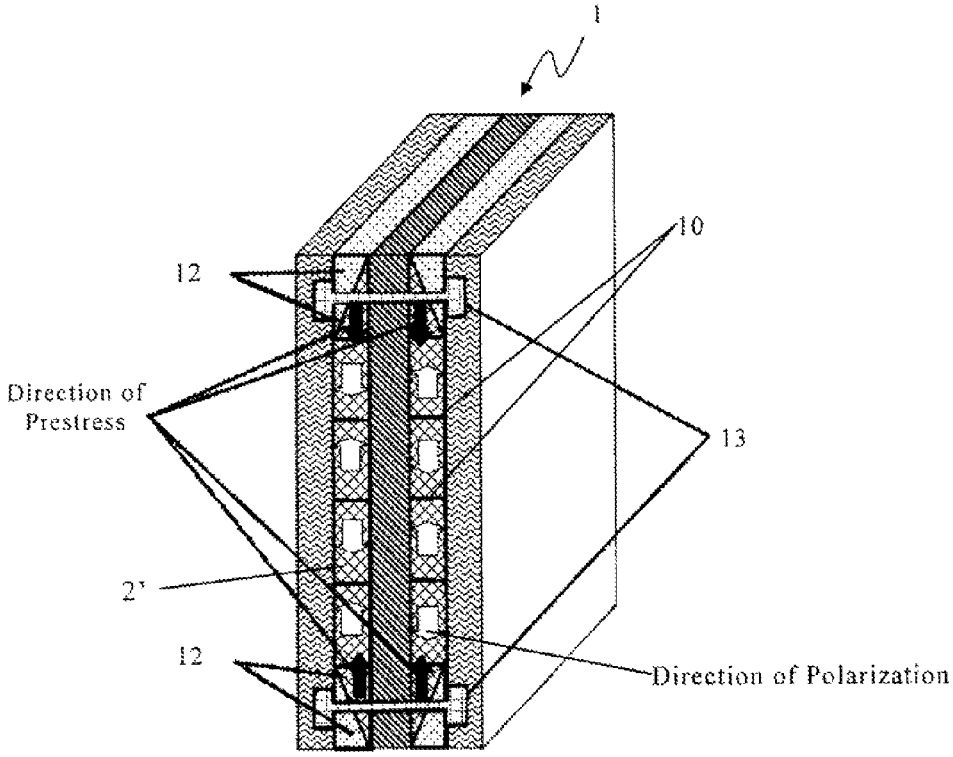
FIG. 13 is a schematic diagram showing the layered plate type piezoelectric resonators wedged and bolted at both ends.

When a bigger acoustic output is desired, there is a problem in which tensile stress is generated when layered plate type piezoelectric resonators 2' are expanded. Generally, a piezoelectric resonator is resistant to the tensile stress that is 1/10 or less of compressive stress. Application of prestress, a compression pressure, to layered plate type piezoelectric resonators 2' can reduce generation of the tensile stress during the expansion of layered plate type piezoelectric resonators 2'. Here, the static compressive biasing stress can be applied to layered plate type piezoelectric resonators 2' by providing wedges 12 at both ends of layered plate type piezoelectric resonators 2' and fastening them with bolts 13 as shown in FIG. 13. Although not shown, the compressive biasing stress can also be applied to layered plate type piezoelectric resonators 2' by making through holes for bolts on layered plate type piezoelectric resonators 2' and fastening there with bolts. As ways of applying the compressive biasing stress to layered plate type piezoelectric resonators 2', blocks are provided for both ends of layered plate type piezoelectric resonators 2' so that bolts provided along layered plate type piezoelectric resonators 2' are tightened on the two blocks.

Now, the joint between bending vibration module 7 and supporting member 9 will be described.

Figure 14:
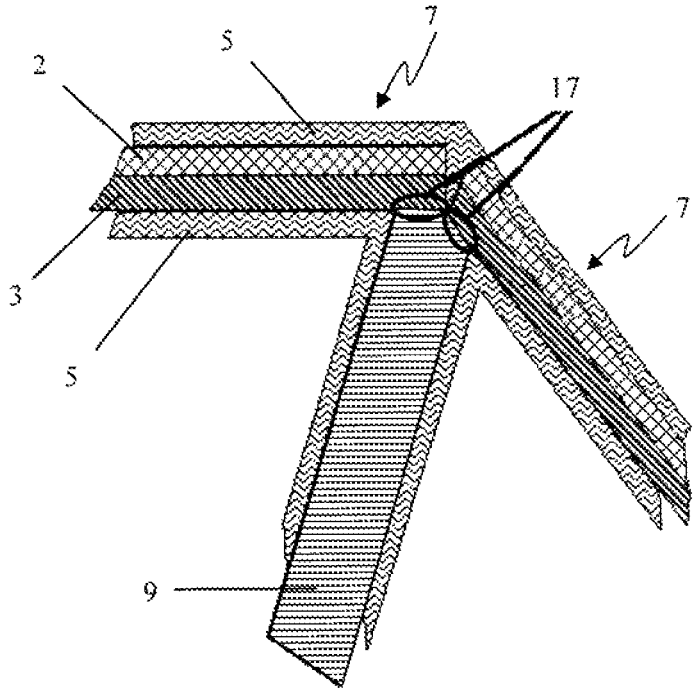
FIG. 14 is a schematic diagram of an enlarged view of the joint between the supporting member and the bending vibration modules.

FIG. 14 is a schematic diagram of an enlarged view of joint 17 between supporting member 9 and bending vibration modules 7 in the unimorph structure. Diaphragms 3 of adjoining bending vibration modules 7 and supporting member 9 are joined at joint 17. That is, since adjoining diaphragms 3 need not to be directly joined together, adjoining diaphragms 3 are joined via supporting member 9 leaving a gap therebetween.

Diaphragms 3 and supporting members 9 may be integrally configured such as by precutting them. With this configuration, the symmetry of cylindrically arranged bending vibration modules 7 is improved so that more stable performance can be realized.

In the case of bending vibration module 7 formed by bending oscillating body 1 in unimorph structure, waterproof structure 5 is required on the outer surface of the acoustic transducer to keep it insulated from surrounding water because plate type piezoelectric resonator 2 is provided only on the outside of diaphragm 3, but it is not required on the inner surface because there is no electrode in it.

In the above-mentioned structure, since diaphragms 3 and supporting members 9 are in the fixed structure, i.e., joints 17 between diaphragms 3 and supporting members 9 are fixedly supported during the vibration of diaphragms 3, deformation of bending vibration modules 7 is restricted in the vicinity of the joints.

Figure 15:
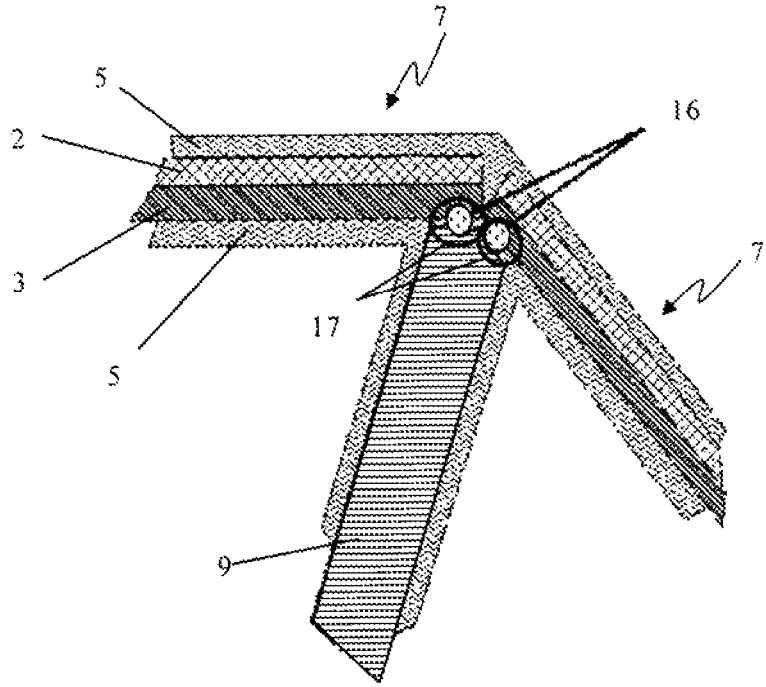
FIG. 15 is a schematic diagram showing the supporting member that is hinged on the bending vibration modules.

Then, as shown in FIG. 15, joints 17 between diaphragms 3 and supporting members 9 are made by hinges 16. With this configuration, supporting members 9 freely support diaphragms 3. Accordingly, since deformation of the bending vibration modules 7 is not restricted in the vicinity of joints 17, the resonance frequency is easily reduced. This configuration can also be applied to the bimorph structure.

Another example of the acoustic transducer according to the present invention will be described.

Figure 16A:
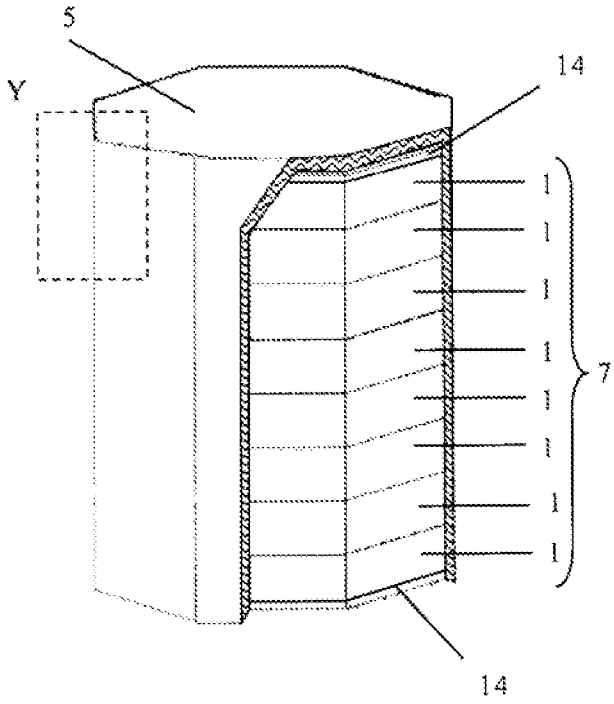
FIG. 16A is a schematic diagram of the appearance of another exemplary embodiment of the acoustic transducer according to the present invention.
Figure 16B:
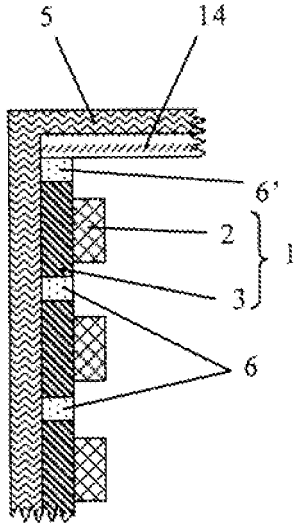
FIG. 16B is a schematic diagram of the cross section of the part denoted by Y in FIG. 16A.

FIG. 16A is a schematic diagram of the appearance of another exemplary embodiment of the acoustic transducer according to the present invention, and FIG. 16B is a schematic diagram of the cross section of the part denoted by Y in FIG. 16A. The acoustic transducer of the present invention has bending vibration modules 7 entirely provided with waterproof structure 5. For easier understanding of the configuration of the acoustic transducer, waterproof structure 5 is partly omitted in FIG. 16A. The components are the same as those in the above-mentioned exemplary embodiments and thus will be omitted from the description.

As shown in FIG. 16A, the acoustic transducer of the exemplary embodiment has one bending vibration module 7 that is formed by a plurality of bending oscillating bodies 1 layered in the axial direction. A plurality of bending vibration modules 7 are cylindrically arranged. Bending vibration module 7 may be formed by only one bending oscillating body 1. Although not shown in the figure, shock-absorbing material 6 is provided between layered bending oscillating bodies 1.

Unlike the free-flooding type acoustic transducer shown in the above-mentioned exemplary embodiment, the acoustic transducer of the exemplary embodiment has end plates 14 at both ends. As shown in FIG. 16B, shock-absorbing material 6' is provided between each of end plates 14 and each of bending oscillating bodies 1 placed at both ends so that end plate 14 does not block deformation of bending oscillating body 1. The other configuration is the same as those of the above-mentioned exemplary embodiments. In FIG. 16A, shock-absorbing materials 6 and 6' are omitted.

With end plates 14, the acoustic transducer of the exemplary embodiment can radiate a sound wave only from its outer surface by keeping water from flowing into it.

The end plate attached acoustic transducer can keep stable performance in relatively shallow water. If this type of acoustic transducer is used in deep water, the water pressure compresses end plates 9 and shock-absorbing material 6', preventing vibration of adjoining bending oscillating bodies 3. Therefore, the above-mentioned free flooding type acoustic transducer is preferably used in deep water.

Yet another example of the acoustic transducer according to the present invention will be described.

The exemplary embodiment uses layered piezoelectric resonators 9' as supporting members 9 to radially deform bending vibration modules 7.

Figure 17:
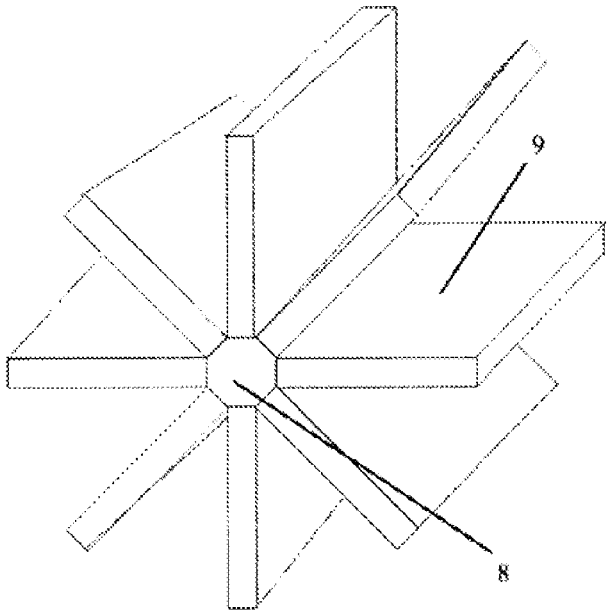
FIG. 17 is a schematic diagram showing only a shaft and supporting members of the acoustic transducer of FIG. 7A.
Figure 18:
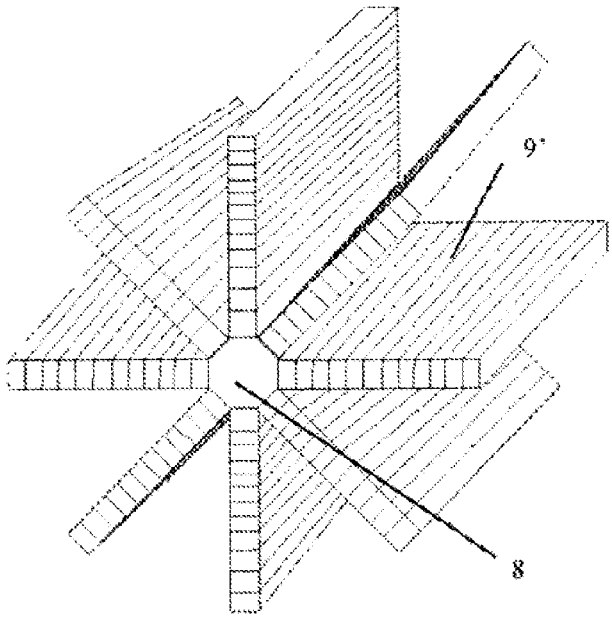
FIG. 18 is a schematic diagram showing layered piezoelectric resonators that are used for the supporting members of FIG. 17.

FIG. 17 is a schematic diagram showing only shaft 8 and supporting members 9 of the acoustic transducer of FIG. 7A, and FIG. 18 is a schematic diagram showing layered piezoelectric resonators 9', which are piezoelectric resonators layered, used as supporting members 9 shown in FIG. 17. Here, waterproof structure 5 is not shown.

In the above-mentioned exemplary embodiments, supporting members 9 radially protrude from shaft 8 as shown in FIG. 17. In this exemplary embodiment, each supporting member 9 is formed by layered piezoelectric resonators 9', which are a plurality of piezoelectric resonators layered, as shown in FIG. 18.

When layered piezoelectric resonators 9' are used as supporting members 9, they need to be provided with a waterproof structure (not shown) to prevent a shot circuit between electrodes of the piezoelectric resonators.

Figure 19:
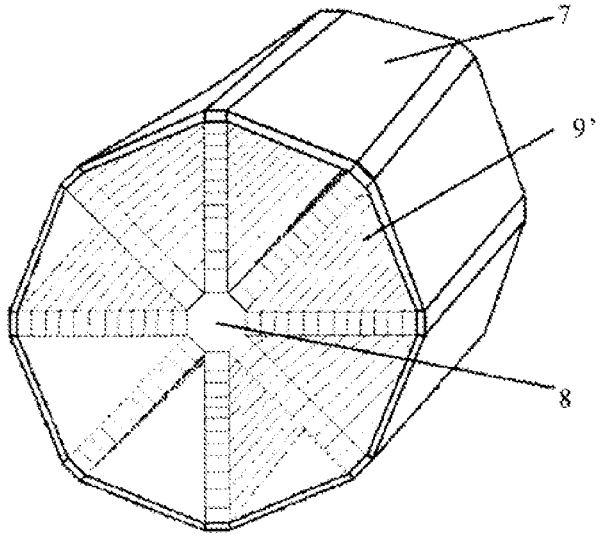
FIG. 19 is a schematic diagram of an acoustic transducer with layered piezoelectric resonators used for supporting members.

FIG. 19 is a schematic diagram of an acoustic transducer with layered piezoelectric resonators 9' used for supporting members 9. The waterproof structure is not shown.

Layered piezoelectric resonator 9' has its one end joined with shaft 8 and the other end with bending vibration module 7. As in the above-mentioned exemplary embodiments, it is preferable to cylindrically arrange bending vibration modules 7, each of which uses bending oscillating bodies 1 formed by diaphragms 3 and bending piezoelectric resonators 2. In place of bending vibration modules 7, only diaphragms 3 without bending piezoelectric resonators 2 joined may be cylindrically arranged.

Figure 20:
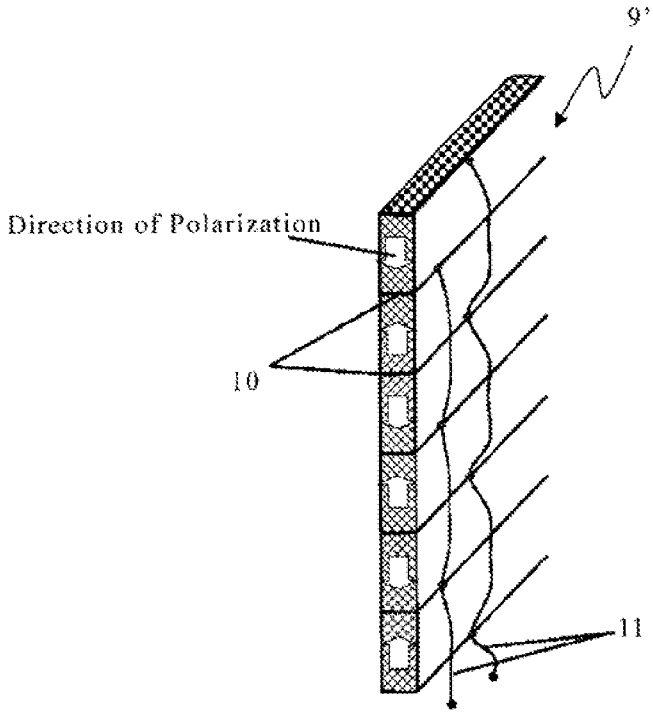
FIG. 20 is a schematic diagram showing the polarized directions of layered piezoelectric resonators.

As shown in FIG. 20, electrodes 10 are provided between piezoelectric resonators of layered piezoelectric resonators 9' and connecting cables 11 are provided for alternately connecting electrodes 10. Piezoelectric resonators are polarized in the direction of each layer and opposite to the polarization direction of adjoining piezoelectric resonators.

With this configuration, when a voltage is applied between connecting cables 11, layered piezoelectric resonators 9' radially expand and contract at a time. By conveying the expanding and contracting deformation to bending vibration modules 7, the acoustic transducer vibrates the bending vibration modules to radiate a sound wave outward from bending vibration modules 7.

Figure 21:
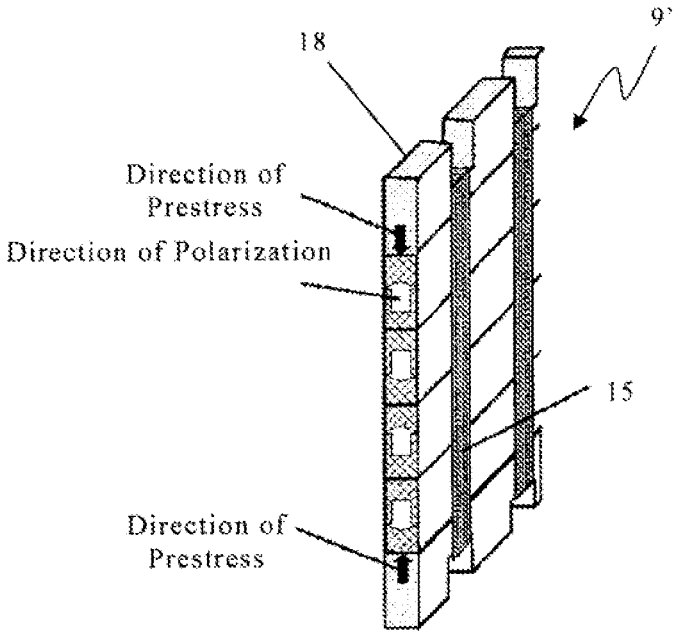
FIG. 21 is a schematic diagram showing layered piezoelectric resonators having fixing materials at both ends and coiled up with tension material.

As in the above-mentioned exemplary embodiments, layered piezoelectric resonators 9' are preferably configured not to be subjected to the tensile stress. As a way of realizing a configuration not to be subjected to the tensile stress, fixing materials 18 are placed at both ends of layered piezoelectric resonators 9' and coiled up with tension material 15 such as glass fiber or carbon fiber as shown in FIG. 21. In this manner, the compressive biasing stress can be applied to layered piezoelectric resonators 9'. As the above-mentioned exemplary embodiments, the compressive biasing stress can be applied by fastening bolts in through holes on layered piezoelectric resonators 9' instead of using tension material 15.

In the exemplary embodiment, by taking advantage of the vibration of bending vibration modules 7 itself and the vibration of bending vibration modules 7 excited by expanding and contracting of layered piezoelectric resonators 9', three resonance frequencies including the resonance frequency of bending vibration modules 7, the resonance frequency of the resonance of water column, and the resonance frequency of resonance of layered piezoelectric resonators 9' in uniformly vibrating the entire bending vibration modules in the radial direction can be used. A wider range of acoustic radiation is available by shifting the three resonance frequencies little by little and by properly setting their phase relations. According to the exemplary embodiment, the fulcrums of bending vibration modules 7, i.e. the joints between layered piezoelectric resonators 9' and diaphragms 3 of bending vibration modules 7, can be changed in accordance with the resonance of bending vibration modules 7. Therefore bigger acoustic radiation can be available.

Figure 22A:
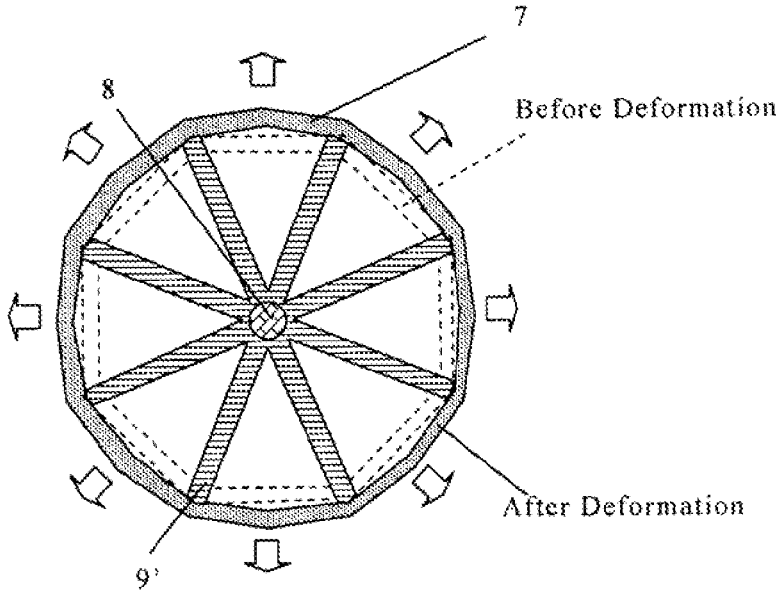
FIG. 22A is a schematic diagram showing the bending vibration modules of the acoustic transducer with layered piezoelectric resonators used for the supporting members expanding outward.
Figure 22B:
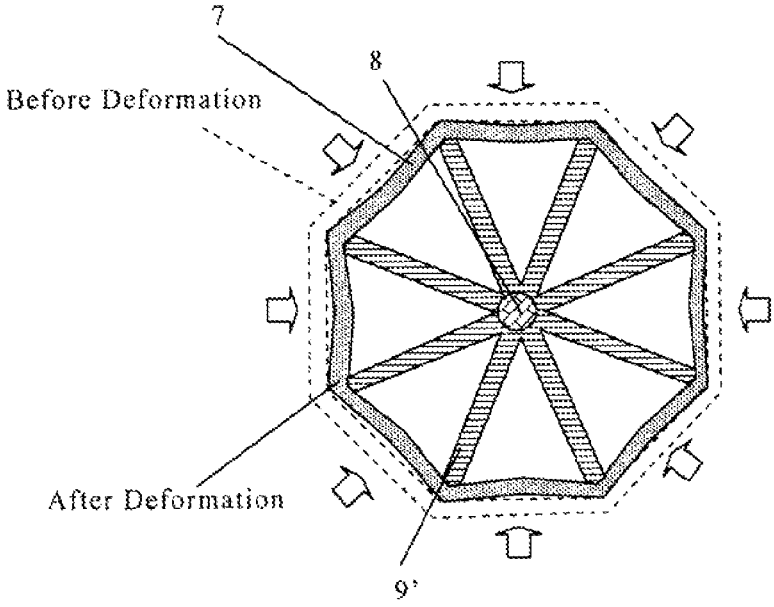
FIG. 22B is a schematic diagram showing the bending vibration modules of the acoustic transducer with layered piezoelectric resonators used for the supporting members expanding inward.

FIG. 22A shows bending vibration modules 7 of the acoustic transducer with layered piezoelectric resonators 9' used for supporting members 9 expanding outward, and FIG. 22B shows bending vibration modules 7 of the acoustic transducer with layered piezoelectric resonators 9' used for supporting members 9 expanding inward As shown in FIG. 22A, when bending vibration modules 7 expand outward, layered piezoelectric resonators 9' deform to push the supporting members outward in the radial direction. As shown in FIG. 22B, when bending vibration modules 7 expand inward, layered piezoelectric resonators 9' deform to pull the supporting members inward in the radial direction. With these movements, the acoustic transducer can move the liquid in the vicinity of the outside surface of the acoustic transducer more largely.

Yet another example of the acoustic transducer according to the present invention will be described.

There will be variation in the height of bending oscillating body 1 or in the thickness of diaphragm 3 or plate type piezoelectric resonator 2. In general, the free flooding type acoustic transducer has higher pressure at the center in the axial direction in the hollow of the cylinder, and lower pressure at both ends. That is, the reaction force, which prevents deformation of diaphragms 3 caused by vibration of plate type piezoelectric resonators 2, is big around the central part in the axial direction of the acoustic transducer, therefore diaphragms 3 deform a little. Further, when bending vibration module 7 is formed by one bending oscillating body 1, bending vibration module 7 deforms a little in the central part, and accordingly, also deforms a little at both ends. That means, the configuration affects the entire acoustic transducer.

Figure 23:
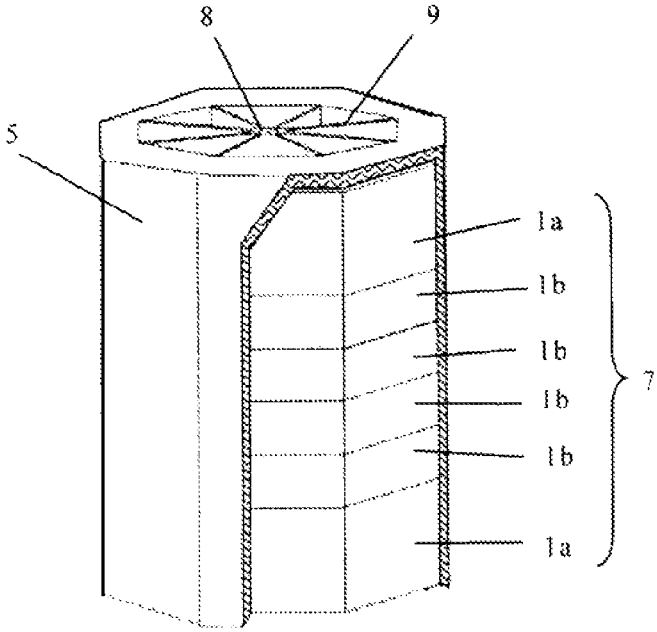
FIG. 23 is a schematic diagram showing that high bending oscillating bodies and low bending oscillating bodies are arranged as bending oscillating bodies.

Then, as shown in FIG. 23, high bending oscillating bodies 1*a* are deployed at both ends and low bending oscillating bodies 1*b* are deployed at the central part in the axial direction, as bending oscillating bodies 1. In other words, various heights of bending oscillating bodies 1 are used to form bending vibration module 7 in accordance with their position in the axial direction. With this configuration, the acoustic transducer can apply stronger power to liquid around the central part in the axial direction. Accordingly, the optimal driving force of acoustic transducer can be reserved.

Figure 24A:
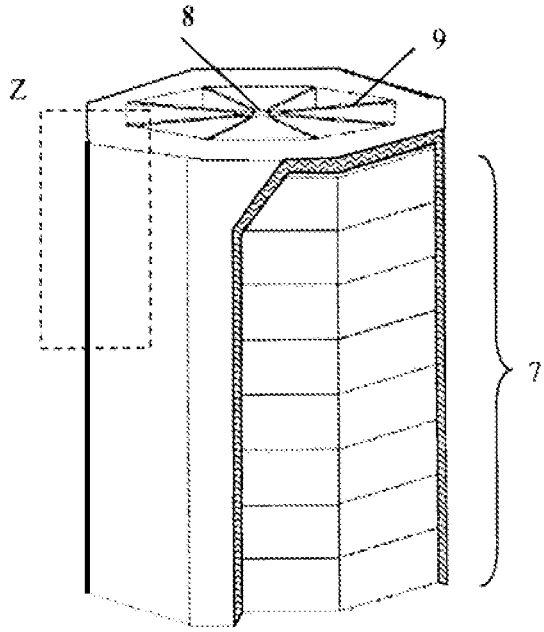
FIG. 24A is a schematic diagram of the appearance of the acoustic transducer with bending vibration modules that are formed by thick bending oscillating bodies having thick plate type piezoelectric resonators and thick diaphragms and thin bending oscillating bodies having thin plate type piezoelectric resonators and thin diaphragms.
Figure 24B:
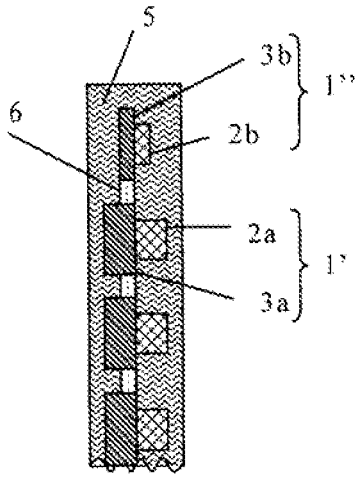
FIG. 24B is a schematic diagram of the cross section of the part denoted by Z in FIG. 24A.

FIG. 24A is a schematic diagram of the appearance of the acoustic transducer, and FIG. 24B is a schematic diagram of the cross section of the part denoted by Z in FIG. 24A; here, the thicknesses of diaphragms 3 and plate type piezoelectric resonators 2 that form bending oscillating body 1 are varied in accordance with their positions in the axial direction. Specifically, thick bending oscillating body 1' formed by thick plate type piezoelectric resonators 2*a* and thick diaphragms 3*a*, and thin bending oscillating body 1" formed by thin plate type piezoelectric resonators 2*b* and thin diaphragms 3*b* are used. Bending vibration module 7 is formed by thick bending oscillating body 1' deployed at the central part and thin bending oscillating body 1" deployed at both sides in the axial direction of the acoustic transducer. With this configuration, the acoustic transducer can apply stronger power to liquid around the central part in the axial direction. Accordingly, the optimal driving force of acoustic transducer can be reserved.

The height of bending oscillating body 1, the thickness of plate type piezoelectric resonator 2, and the thickness of diaphragm 3 may be changed at the same time.

The acoustic transducer according to the present invention can be used for generating full-power sound wave especially at a low frequency in water. This low frequency full-power sound wave is useful in detecting a body traveling in water, discovering a body buried under the bottom of the sea, investigating stratum under the seabed, and the like.

According to the present invention, the acoustic transducer can use a plurality of resonance frequencies, therefore, can perform highly efficient acoustic radiation in a wide frequency band.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. An acoustic transducer comprising:

a plurality of cylindrically arranged bending vibration modules, each of which is formed by at least a bending oscillating body that has at least a plate type piezoelectric resonator and diaphragm; and a plurality of supporting members for supporting said bending vibration modules, wherein each supporting member radially protrudes from a shaft provided at the center of said cylindrically arranged bending vibration modules and is joined with the ends of the diaphragms of said adjoining bending vibration modules.

2. The acoustic transducer according to claim 1, wherein the diaphragm is hinged on said supporting member.

3. The acoustic transducer according to claim 1, wherein each of said bending vibration modules includes a plurality of the bending oscillating bodies, which respectively differ in height according to their positions in the axial direction.

4. The acoustic transducer according to claim 1, wherein each of said bending vibration modules includes a plurality of the bending oscillating bodies, which respectively differ in thickness of the plate type piezoelectric resonators and thickness of the diaphragms according to their positions in the axial direction.

5. The acoustic transducer according to claim 1, wherein the bending oscillating body has a unimorph structure, in which the plate type piezoelectric resonator has an electrode on either side to be polarized in the thickness direction that is opposite to the diaphragm.

6. The acoustic transducer according to claim 1, wherein the bending oscillating body has a bimorph structure, in which each of the plate type piezoelectric resonators has an electrode on either side to be polarized in the thickness direction that is opposite to the diaphragm.

7. The acoustic transducer according to claim 1, wherein the bending oscillating body has a unimorph structure that has layered plate type piezoelectric resonators, and the diaphragm, and an electrode is provided on each joint between the layered plate type piezoelectric resonators and every other electrode is connected together so that each of the plate type piezoelectric resonators is polarized vertically to the electrode and opposite to the polarized direction of the adjoining plate type piezoelectric resonators.

8. The acoustic transducer according to claim 1, wherein the bending oscillating body has a bimorph structure that has layered plate type piezoelectric resonators, and the diaphragm, and an electrode is provided on each joint between the layered plate type piezoelectric resonators and every other electrode is connected together so that each of the plate type piezoelectric resonators is polarized vertically to the electrode and opposite to the polarized direction of the adjoining plate type piezoelectric resonators and also opposite to the polarized direction of the plate type piezoelectric resonator across the diaphragm.

9. The acoustic transducer according to claim 7, wherein prestress is applied in the direction of each layer of the layered plate type piezoelectric resonators.

10. The acoustic transducer according to claim 1, wherein said supporting member is formed by layered piezoelectric resonators that are piezoelectric resonators radially layered from the shaft.

11. The acoustic transducer according to claim 10, wherein prestress is applied in the direction of each layer of the layered piezoelectric resonators.

12. An acoustic radiation method comprising at least:

applying of a voltage to a plurality of said cylindrically arranged bending vibration modules, each of which is formed by at least a bending oscillating body that has at least a plate type piezoelectric resonator and diaphragm; and generating of bending deformation on said bending vibration module in each section between joints, each of which joins the supporting member with the ends of said respective diaphragms of said adjoining bending vibration modules, wherein the supporting members protrude from a shaft provided at the center of said bending vibration modules for supporting said bending vibration modules.

13. The acoustic radiation method according to claim 12, wherein the diaphragm is hinged on said supporting member so that the diaphragm is vibrated while deformation of said bending vibration module is not restricted near the joint part.

14. The acoustic radiation method according to claim 12, wherein the shaft is formed by layered piezoelectric resonators, and the method further comprising:

applying a voltage to the layered piezoelectric resonators to expand and contract the layered piezoelectric resonators in the radial direction so that said bending vibration modules vibrate.

15. The acoustic radiation method according to claim 14, wherein the polarized direction is set vertical to the electrodes provided between the piezoelectric resonators and opposite to the polarized direction of the adjoining piezoelectric resonators, and the method further comprising:

applying a voltage to the electrodes to uniformly expand and contract the layered piezoelectric resonators so that a plurality of said cylindrically arranged bending vibration modules uniformly vibrate inwardly and outwardly.

16. The acoustic radiation method according to claim 14, wherein the radially expanding deformation of the layered piezoelectric resonators deforms a plurality of said cylindrically arranged bending vibration modules outwardly, and the radially contracting deformation of the layered piezoelectric resonators deforms a plurality of said cylindrically arranged bending vibration modules inwardly.

17. The acoustic radiation method according to claim 14, wherein the layered piezoelectric resonators are made to radially expand and contract in a state where the tensile stress of the layered piezoelectric resonators are reduced by applying prestress to the layered piezoelectric resonators.

* * * * *